US006393728B1

(12) United States Patent
Sairanen et al.

(10) Patent No.: US 6,393,728 B1
(45) Date of Patent: May 28, 2002

(54) METHOD AND APPARATUS FOR DRYING PULP

(75) Inventors: Paavo Sairanen, Gorizia (IT); Olli Huhtala, Littoinen (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/719,092

(22) PCT Filed: Jun. 21, 1999

(86) PCT No.: PCT/FI99/00541

§ 371 (c)(1),
(2), (4) Date: Dec. 8, 2000

(87) PCT Pub. No.: WO00/01994

PCT Pub. Date: Jan. 13, 2000

(30) Foreign Application Priority Data

Jul. 2, 1998 (FI) ..... 981523

(51) Int. Cl.[7] ..... B67D 5/62

(52) U.S. Cl. ..... 34/398; 34/424; 34/400; 34/68; 34/69; 34/70

(58) Field of Search ..... 34/424, 425, 134, 34/135, 136, 418, 397, 398, 400, 68, 69, 70; 432/107, 109, 112, 115, 118

(56) References Cited

U.S. PATENT DOCUMENTS 3,478,679 A 11/1969 Bauserman
4,112,578 A 9/1978 Sanford
4,492,478 A * 1/1985 Ito et al. ..... 366/28
4,541,929 A 9/1985 Janusch
5,263,267 A * 11/1993 Buttner et al. ..... 34/519
5,562,832 A * 10/1996 McOnie et al. ..... 210/710
5,879,566 A * 3/1999 Snyder et al. ..... 210/771
6,256,902 B1 * 4/2001 Flaherty et al. ..... 34/379

FOREIGN PATENT DOCUMENTS

EP 0 671 503 A2 9/1995

* cited by examiner

*Primary Examiner*—Denise L. Esquivel
*Assistant Examiner*—Mark S Shulman
(74) *Attorney, Agent, or Firm*—Nixon & Vanderhye P.C.

(57) ABSTRACT

A fiber containing pulp, such as chemical pulp, mechanical pulp, thermomechanical pulp, TMP, de-inked water, or fiber containing sludge, is dried in an effective and efficient manner. The wet pulp is first dewatered mechanically, such as by using a drum or screw press. Then dewatered pulp is passed to a dryer. The dryer has first and second apertured cylindrical surfaces defining a gap between them, and drying gas is blown through one of the apertured surfaces, then through a pulp layer moving in the drying gap between the cylindrical surfaces, and then through the apertures in the other cylindrical surface, to evaporate water from the pulp and dry it to a dry matter content of over 80%, preferably about 85–90%.

31 Claims, 3 Drawing Sheets

METHOD AND APPARATUS FOR DRYING PULP

CROSS-REFERENCE TO RELATED APPLICATION

This application is a U.S. national phase of International Application No. PCT/FI99/00541 filed Jun. 21, 1999.

BACKGROUND AND SUMMARY OF THE INVENTION

The object of the present invention is a method and device as specified in the independent claims presented below for drying fibre-containing pulp, such as chemical pulp, mechanical pulp, thermomechanical pulp, TMP, deinked pulp or fibre-containing sludge. The invention relates especially to a method in which the wet pulp is first dewatered mechanically in a mechanical water separator such as a drum or screw press, and in which water is then evaporated from the pulp by utilising drying gas.

Today, fibre-containing pulps, such as chemical pulp, are dried largely by means of techniques known from paper machines, possibly in modified form. This means that the wet end of a pulp drying machine, where the pulp web is formed, is required to have properties corresponding to those of the wet end of a paper machine, in order to make the pulp web such that it is able to pass through the entire drying process, all the way through to the baling line, without problem. This type of paper machine technique, which is intended for the manufacture of a more highly refined finished product—paper—is thus unnecessarily sophisticated and also expensive for a pulp product. After all, the sole purpose of a pulp drying line is to remove water from the pulp without damaging the fibres, although it is true that certain properties of pulp, such as its dimensional stability, improve with drying.

The end product obtained from the pulp drying machine, a dried pulp web, always ends up in the pulper, sooner or later, to be mixed with water again. Therefore, basically the only important aspect in drying pulp as well as other similar materials, is to obtain a high dry matter content and yield at the wet end of the pulp drying process. The pulp drying process should be such that the pulp can be dewatered without having to be formed into a pulp web possessing the properties of paper or board.

For this reason it has previously been suggested that the pulp be dried as flakes rather than as a web. In the Flash Dryer flake dryer the flakes dry while mixed with hot gas as they are conveyed pneumatically in conveyor pipes. After drying, the flakes have to be separated in separate cyclones from the carrier gas. A common feature of flake dryers is the short drying time, since water diffuses to the surface more easily from flakes than from inside a compact web. The capacity of conventional Flash Dryer flake dryers is, however, relatively low, typically less than 500 t/day. They also require large duct systems for conveying the pulp-air mixture. This is why, despite the good drying efficiency obtained with the Flash Dryer technique, techniques corresponding to those used in paper machines are generally applied in pulp drying. It has previously also been suggested that a conventional rotary drum dryer be used for drying flaky pulp.

The aim of the present invention is to achieve an improved method and device for drying fibre-containing pulp.

The aim is especially to achieve an easily runnable pulp dryer, that is, a dryer that makes it possible to avoid the difficult web formation stage and achieve the advantages of through-flow drying.

The aim is also to achieve a pulp dryer that has low requirements concerning the pulp material supplied to it, that is, a pulp dryer which allows the use of various mechanical devices for removing water from the pulp before the drying proper.

A further aim is to achieve a pulp dryer with easy start-up and run-down, and which is not susceptible to interruptions.

In order to achieve the aims presented above, the method and device relating to the invention are characterised by what is specified in the characterising parts of the independent claims presented below.

In a typical drying process relating to the invention the pulp to be dried, which has preferably first been dewatered by means of mechanical dewaterers, such as a drum or screw press, to a dry-matter content typically exceeding 45%, and in which pulp the fibres have been separated from one another in a fine shredder or the like, is arranged to pass, according to a preferred embodiment of the invention, through a gap-like drying space limited between a first and a second surface provided with apertures, in which gap or drying space drying gas is blown through the pulp layer in order to evaporate water from it.

In the dryer, the distance between the cylindrical or straight surfaces provided with apertures is preferably within the range of 40–120 mm, typically about 80 mm, which means that a gas-permeable pulp layer having a thickness of approximately 40–120 mm, or approximately 80 mm, can be formed in the annular or otherwise shaped gap formed between them.

The surfaces with apertures can be formed, for example, of perforated plate having e.g. round or gap-like apertures, or of supporting netting onto which is fitted a fine-meshed netting provided with meshes of the desired size.

The surfaces of the pulp dryer that are provided with apertures are preferably cylindrical and fitted concentrically inside each other so that an annular gap is formed between them. One or more means are preferably fitted in the gap, by which means the pulp layer can be conveyed forward in the gap. The pulp to be dried is preferably introduced at one end of the annular gap and the dried pulp is discharged from the other end. The means conveying the pulp layer are preferably wing-like means fixed in a spiral manner on the inner cylindrical surface. The inner cylindrical surface is preferably arranged to rotate around its axis, whereby the spirally affixed wing-like surfaces, which preferably extend from the first surface almost to the second surface, convey the pulp layer forward as they rotate. The means may obviously also be fixed to the second surface. If so desired, this second surface may rotate.

The diameter of the inner cylindrical surface or of the inner tube may, for example, be about 2–5 m. The length of the cylinders may, for example, be about 15–40 m.

The drying gas, typically drying air, is blown through the apertures in the first surface mainly perpendicularly towards the pulp layer travelling in the drying space between the surfaces, and is discharged from the said pulp layer through the apertures in the second surface. The first and/or second surface provided with apertures is preferably arranged to support the pulp layer.

If the drying air is always blown towards the same side of the pulp layer, e.g. always through the inner cylindrical surface towards the outer cylindrical surface, the pulp layer will dry more rapidly on the side that is towards the surface of the inner cylinder. In some cases this may not be desirable.

In such a case, the drying gas may be blown through the pulp layer alternately in one direction and its opposite direction. This may be achieved, for example, by dividing the exhaust gas collection hood covering the outer cylinder into two parts, in one of which there is underpressure and in the other overpressure compared with the internal pressure in the inner cylinder. In this way, the drying gas can be made to travel radially in different directions at different points in the gap-like drying space, that is, the drying gas is alternately blown inwards towards the inner cylinder and sucked outwards from the inner cylinder. The pulp to be dried, which is arranged to travel forward, for example, along a spiral path around the inner cylinder, will thus alternately pass the point where the drying gas travels inwards from the outside and the point where the drying gas travels in the opposite direction. In this way the pulp layer can also be dried evenly through the web.

In the dryer, the pulp layer is dried with drying gas at a temperature of about 100–300° C. from a dry matter content of about 30–60% to a dry matter content of over 80%, typically about 85–90%. Drying may take place in one or more at least partly separate successive stages, which means that the temperature may differ at the different stages.

The pulp to be dried is preferably formed into a mat-like air-permeable pulp layer of even thickness over the casing of the inner cylindrical surface. The second casing of the outer cylindrical surface supports the pulp layer on its other side while the wing-like means push the pulp layer along the casing of the inner surface towards the outlet. The density of the pulp layer is advantageously about 0.2–0.5 t/m$^3$, preferably about 0.3 t/m$^3$.

The dryer relating to the invention, which is provided with cylindrical surfaces, may be a modified screw conveyor comprising

- a perforated rotating inner tube which forms a first cylindrical surface,
- a perforated outer casing which forms a second cylindrical surface,
- means fitted in a spiral manner, "a screw", for pushing the pulp layer forward in the annular space between the inner tube and the outer casing,
- a closed cover or hood covering the outer casing, and
- means for feeding drying gas from the perforated inner tube through the pulp layer in the gap-like space, and further through the perforated outer casing, into the closed hood or cover.

In a screw conveyor-type solution, the structure enables the use of quite considerable pressure differences across the web, even in the case of weak-fibre pulps, such as deinked pulps. The pressure differences may be of the order of about 500–1000 Pa, or even more. The technique is simple. The dryer is easy to start up and run down. It is not susceptible to interruptions.

There are no special requirements as regards the pulp fed to the dryer relating to the invention. It is, however, advantageous to separate water from the pulp mechanically before drying proper, so that its dry matter content will be 30–60%, typically about 5%, which means that it will be unnecessary to use a large amount of thermal energy to remove the said water. Water can be separated from the wet pulp by means of a wide variety of mechanical devices, such as drum or screw presses or precipitators.

In a dryer relating to the invention, the drying proper performed by means of a hot gas can be arranged to take place in two or more successive stages connected in series. This allows the necessary number of shorter dryers similar to a screw conveyor, or other types of dryers relating to the present invention to be connected in succession on one drying line. The dryers are connected so that the feed inlet of the second stage is connected to the discharge outlet of the first stage, etc. This means that the dryer of the first stage can advantageously be fitted on a higher level than the dryer of the second stage, in which case the pulp dried at the first stage transfers easily to the second stage on a lower level. The dry matter content of the pulp is increased stage by stage. The drying may take place, for example, in three stages, in which case the pulp is dried from a dry matter content of 35% to a dry matter content of 50% at the first stage, and further to a dry matter content of 70% at the second stage, and further to a dry matter content of 95% at the third stage.

Phased drying can also be achieved in a single dryer by dividing the dryer into several successive drying zones or segments.

In a dryer divided into different drying zones or segments, or in several successive dryers, the drying process can be regulated by arranging so that at least some of the separate parts, segments or zones of the dryer have their own return air systems. In this way, considerably higher drying gas—typically drying air—temperatures can be applied at the beginning of drying than at the end of drying. At the beginning, when there is still a lot of free water in the pulp, the temperature of the fibres will not rise too high, and thus the application of high temperatures will not impair the quality of the pulp. At the end of drying, when the water is mainly bound water, lower temperatures can be applied. The temperature of the pulp to be dried can also be affected by adjusting the humidity of the return air. The temperature of the pulp always settles at a temperature corresponding to the wet bulb temperature of the return air.

By connecting several dryers adjacent to one another it is possible to achieve a high capacity, good flexibility of capacity, and also the possibility of servicing without stopping the entire drying line. Furthermore, the dryer can be arranged to have an automatic cleaning stage for the surfaces with apertures, or it can be provided with brushes for self-cleaning.

The capacity of the dryer is affected e.g. by air flow variables, the thickness of the pulp layer, the speed at which the pulp advances in the gap-like drying space. The speed of advance of the screw is, for example, about 0.2 m/s. The speed of advance of the pulp layer is dependent on the advance of the wing-like means, that is, the screw conveyor, and on the speed of rotation.

In the dryer relating to the invention, the advantages of a screw conveyor and a drum dryer are combined in an advantageous manner. The drying takes place by a through-flow technique, by means of which high evaporation per square meter is achieved. In the solution relating to the invention, however, the difficult web formation stage that is normally required in conventional pulp drying in order to achieve uniform drying is not required.

Since in the solution relating to the invention the pulp to be dried does not have to be formed into a web, this solution can also be used for drying considerably weaker pulp grades than before, such as deinked pulps or new types of pulps such as maize or cane pulps.

BRIEF DESCRIPTION OF THE DRAWINGS

The invention is described in greater detail in the following, with reference to the appended drawings in which.

DETAILED DESCRIPTION OF THE DRAWINGS

Figure 1:
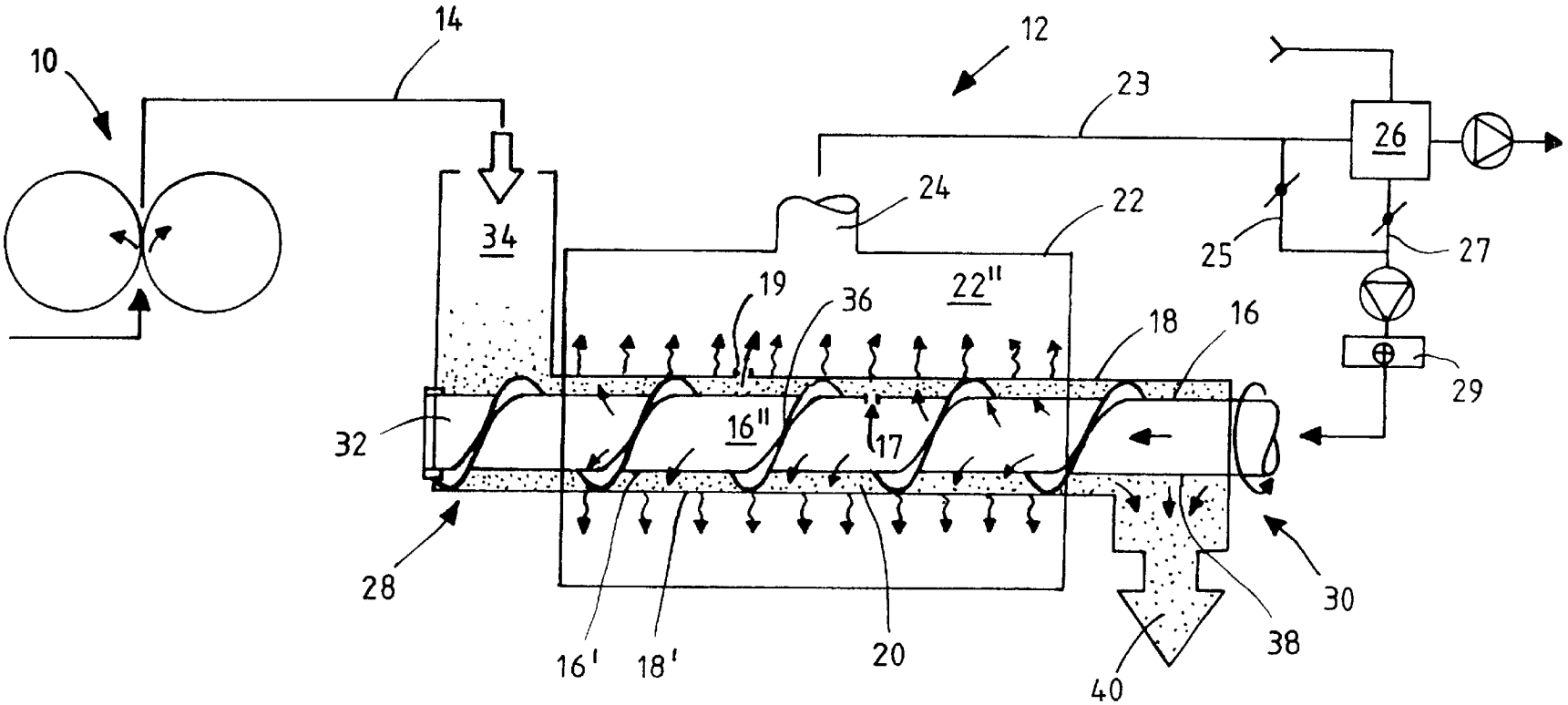
FIG. 1 shows diagrammatically a longitudinal cross-section of the device relating to the invention for drying pulp.

FIG. 1 shows a pulp dryer relating to the invention which comprises a drum press 10, in which water is removed mechanically from the wet pulp at the first stage, giving a dry matter content of about 30–60%, and a pulp dryer 12 similar to a screw conveyor, in which dryer the pulp drying proper takes place at the second stage, giving a dry matter content of >80%, for example, 85–90%. The pulp to be dried is conveyed from the drum press 10 acting as a water separator, e.g. by means of a conventional screw conveyor 14 or the like, via a defibrator, fine shredder, fine pulveriser, or the like, not shown, to make the said pulp fluffy, to the dryer proper 12.

The dryer 12 proper comprises two cylindrical means, an inner tube 16 equipped with a casing 16' provided with apertures or perforations, and an outer tube 18 equipped with a casing 18' provided with apertures or perforations, the said tubes being fitted concentrically inside each other to form an annular gap 20 between them, which forms a space in which the pulp is actually dried. The casing parts 16', 18' of the inner tube 16 and outer tube 18, which parts are provided with perforations 17,19, are covered by a closed cover or hood 22. Means, not shown in the figure, are connected to the inner tube 16, for rotating the tube around its axis.

Means, not shown in the figure, are connected to the inner tube 16, for supplying hot gas, typically hot drying air, through the perforations or apertures, such as round perforations, slots or netting meshes in the casing 16' of the inner tube, to a gap-like space 20 and through the pulp layer in the gap. From the gap-like space the drying gas is taken, in the form of cooled and humid exhaust gas, through the holes in the casing 18' of the outer tube 18 to the hood 22, from where the gas is removed through the discharge outlet 24, by means of the duct 23, to heat recovery 26. The exhaust gas can be taken out of the system completely, or part of it can be taken back from the duct 23 as return air, in which case the air being circulated is taken via the duct 25 to the air duct 27, and from there further by means of a fan to the heater 29, from where it is taken to the inner tube 16 after heating.

In the case shown in FIG. 1, the inner tube 16 is longer than the cylindrical outer tube 18 and partly extends outwards both at the feed end 28 of the dryer and its discharge end 30. At the feed end, a feed chamber 34 or a feed trough is formed on the part 32 protruding outwards from the outer casing of the inner tube 16, to which feed chamber pulp from the drum press 10 is fed by means of a screw conveyor 14. From the feed chamber the pulp is fed onto the inner tube 16, from where it is conveyed into the annular drying space 20 between the inner tube and outer tube 18. At the feed chamber 34 there are no apertures or perforations in the inner tube. The pulp is formed into a mat-like pulp layer on the casing of the inner tube 16. To the outer surface of the inner tube 16 are fitted screw means 36, that is, wing-like means fixed to the tube spirally, the apex of the said means mainly corresponding to the distance between the casings of the inner tube 16 and the outer tube 18. The screw means 36 are fitted to the casing of the inner tube in such a way that, when the inner tube is rotated, the screw means forces or pushes the mat-like pulp layer formed on the inner casing to travel spirally forward in the gap-like space 20 from the feed end 28 of the dryer towards its discharge end 30 along the surface of the inner tube. The pulp to be dried, that is, the pulp layer, can be arranged to travel typically 5–25 times around the inner tube as the pulp travels from the inlet end 28 of the dryer to its outlet end 30.

The wing-like means 36 can advantageously be formed on the outer surface of the inner cylinder so that the pitch of the spiral formed by the means decreases from the feed end 28 of the dryer towards its discharge end 30. The decrease in the pitch of the spiral is preferably dimensioned to be such that the reduction in the drying space 20 limited by the spiral wings towards the discharge end of the dryer will correspond to the reduction in volume of the pulp which is drying and diminishing in volume. The drying pulp thus fills the gap between the inner and outer tube from the feed end right up to the discharge end.

At the discharge end 30 of the dryer, an opening 38 is formed in the outer tube, through which opening the dried pulp, which has travelled on the inner tube to the discharge end, can detach itself from the inner tube and be discharged through the outlet 40.

The gas chamber 16" of the inner tube 16 can be divided in the axial direction into separate sectors or segments in which the temperature of the drying gas may vary. This means that drying gas at varying temperatures can be supplied to the pulp layer in the different sectors as it travels in the drying space. In this way, relatively hot drying gas can be supplied to the pulp at the start of the drying space and less hot gas at the end of the said space. Hot gas can also be supplied to pulp that is still relatively wet without danger of overheating.

Figure 2:
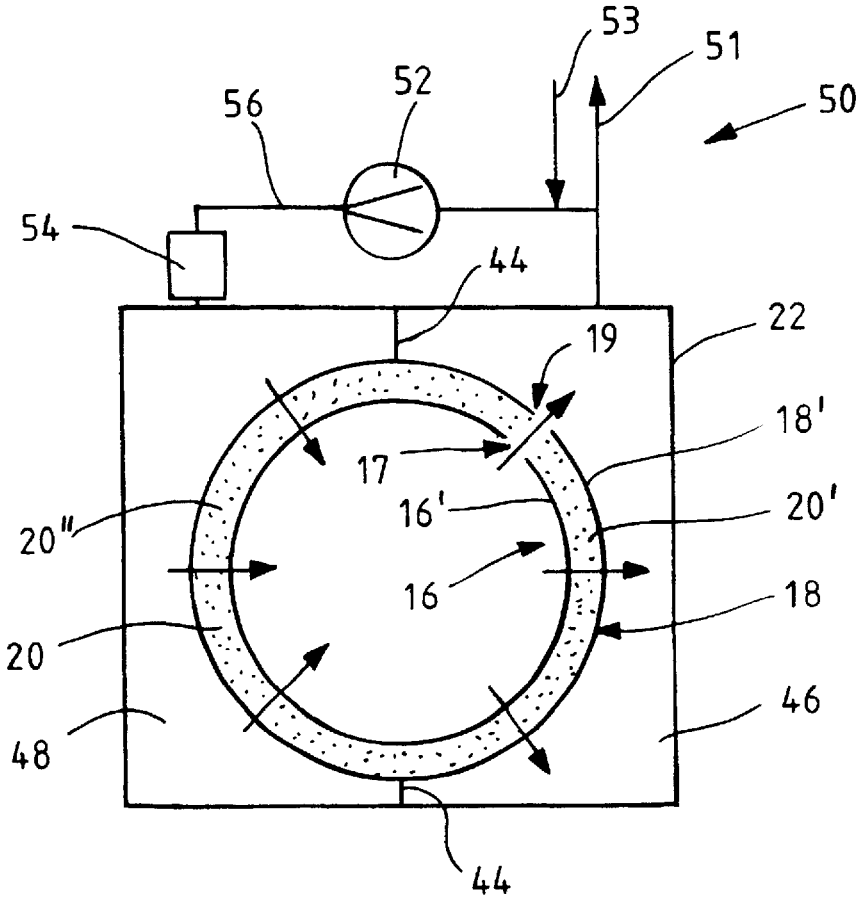
FIG. 2 shows a vertical cross-section of a device of the type shown in FIG. 1 relating to a second embodiment of the invention.

FIG. 2 shows the cross-section of a dryer according to a second embodiment of the invention, corresponding in principle to that shown in FIG. 1. In the embodiments shown in FIGS. 1 and 2, however, the circulation of drying gas is arranged in different ways. In the case of FIG. 1, the flow of drying gas has been arranged so as to take place via the inner cylinder or tube 16 so that the entire drying gas flow is fed into the cylinder or tube 16 from its discharge end. In the case of FIG. 2, the drying gas is supplied to the drying space 20 from the hood.

In the case of FIG. 2, the hood 22 is divided into two parts. The drying gas is fed to the dryer via the second hood part, that is, outside the outer cylinder or tube. From the hood the drying gas is supplied via the drying space to the inner cylinder or tube. From the inner cylinder or tube the drying gas is taken further, via the second hood part, out of the dryer.

The dryer shown in FIG. 2 comprises an inner cylinder 16, the casing 16' of which is provided with a large number of apertures 17, and an outer cylinder 18, the casing 18' of which is provided with a large number of apertures 19. Only one of each of the apertures 17 and 19 is shown in the figure by way of an example. Between the cylinders is formed a gap-like drying space 20. The outer cylinder 18 is covered by a hood 22 which is divided into two parts 46 and 48 by means of two intermediate walls 44 fitted in the longitudinal direction of the cylinders. The parts of the hood are thus in the axial direction.

A return air system 50 is connected to the dryer, which system comprises a fan 52 and a steam radiator 54 or the like for heating the drying air. Air is sucked by means of the fan 52 from the first hood segment 46 and the air is taken by means of the duct 56 to the steam radiator 54 and further to the second hood segment 48. Underpressure is thus formed in the first hood segment 46 and overpressure in the second hood segment 48, in comparison to the pressure inside the casing 16. The return air system comprises an exhaust duct 51 for the exhaust air and an inlet aggregate 53 for replacement air.

When air travels from the inner cylinder 16 via the apertures 17 to the hood, due to the underpressure in the first hood segment 46, drying air will flow outwards through the pulp layer 20' from the inside. As the fan at the same time blows drying air from the second hood segment 48 to the inner cylinder 16, drying air will flow inwards through the pulp layer 20" from the outside.

Figure 3:
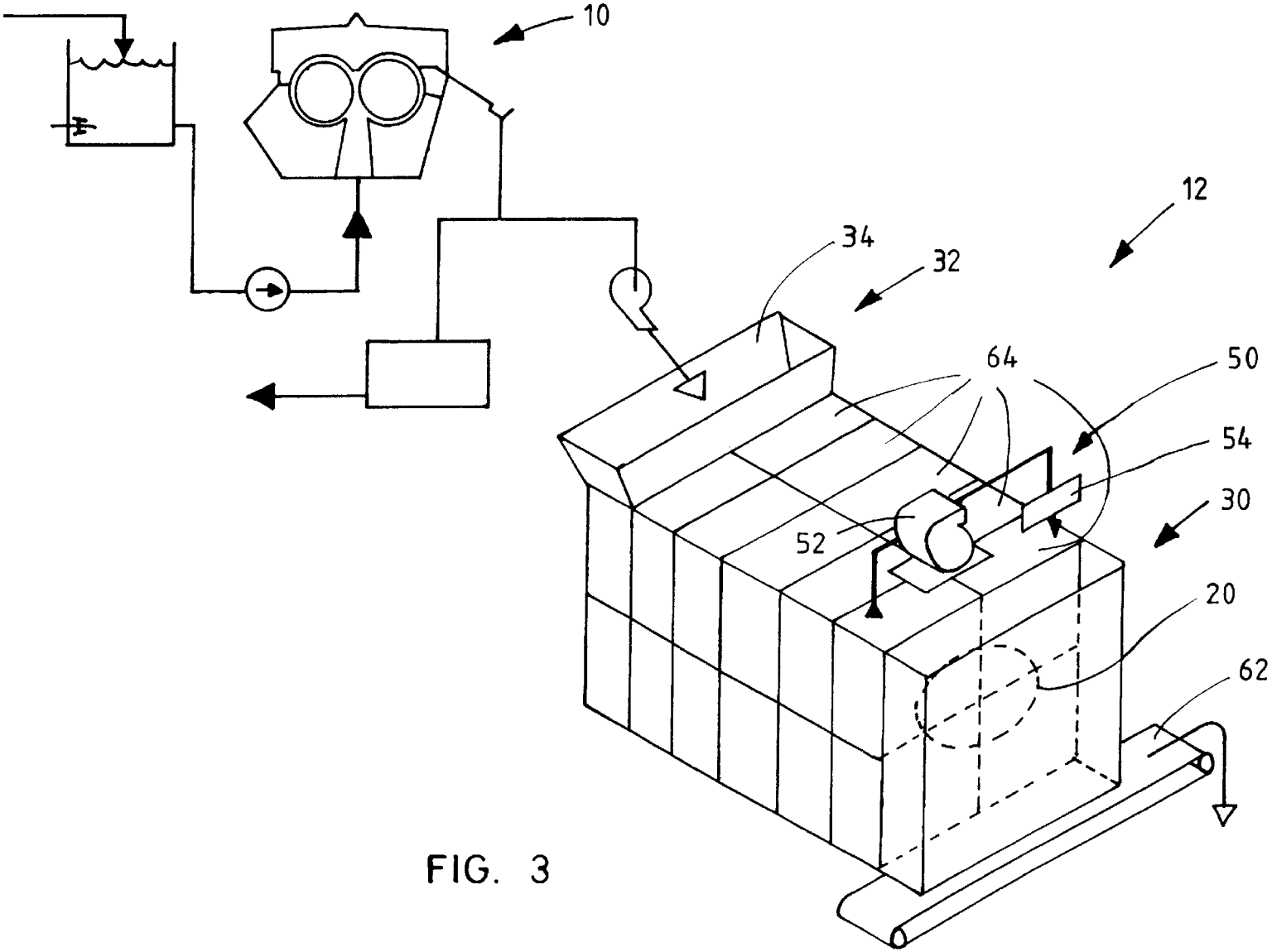
FIG. 3 shows a diagrammatic view of the device relating to the invention.

FIG. 3 shows a diagrammatic view of the device relating to the invention which comprises a drum press 10, after which is fitted the dryer 12 relating to the invention. The dryer comprises a feed end 32, which includes a feed trough 34 for feeding pulp into the dryer, a discharge end 30 from which the dried pulp is dropped onto the discharge conveyor 62. The actual dryer section is divided into five successive drying segments 64. Each drying segment 64 preferably has its own return air system 50 with a fan 52 and a steam radiator 54, although only the return air system of one sector is shown in the figure. The figure indicates with broken lines the drying space 20 formed by the cylinders inside the hoods.

Figure 4:
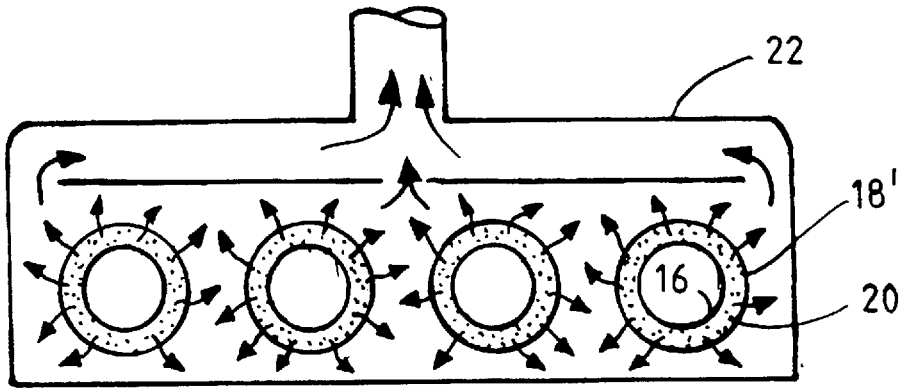
FIG. 4 shows diagrammatically a vertical cross-section of a device incorporating several dryers relating to the invention adjacent to each other.

FIG. 4 shows a transverse cross-section of a pulp dryer relating to the invention, in which the dryer solution shown in FIG. 1 is applied as regards air circulation. In the dryer several drying gaps 20 similar to a screw conveyor and formed of cylindrical surfaces 16, 18 are fitted adjacent to each other into the same hood 22. By combining dryers, space is saved. The drying gaps fitted adjacent to each other also gives the drying process flexibility, since it is relatively easy to close one drying gap, e.g. for servicing or any other reason and to bring it into use again when necessary.

Naturally dryers provided with the type of air circulation shown in FIG. 2 can also be fitted adjacent to each other in the same hood. In such a case the hood can be divided, e.g. by means of a horizontal intermediate wall, into two parts in order to achieve the desired air circulation.

The aim is not to limit the invention to the embodiments presented above by way of examples, but on the contrary the aim is to apply it extensively within the scope of protection defined in the claims below.

What is claimed is:

1. A method for drying a wet pulp, comprising:

(a) mechanically dewatering the wet pulp; and then (b) passing the pulp through a drying gap defined by first and second apertured cylindrical surfaces by pushing the pulp along the surfaces, and while simultaneously blowing drying gas through one of the apertured cylindrical surfaces, through the pulp in the gap to evaporate water from the pulp and through the apertures in the other cylindrical surface.

2. A method as recited in claim 1 wherein (a) is practiced using wet pulp having a dry matter content between about 30–60%, and wherein (a) and (b) are practiced to produce final pulp having a dry matter content of about 85–90%.

3. Apparatus for drying a fiber containing pulp, comprising:

a mechanical dewaterer which dewaters wet pulp, and having a discharge; and a dryer operatively connected to the discharge of the mechanical dewaterer, said dryer comprising first and second apertured cylindrical surfaces defining a gap between them, means for conveying pulp along the first or second cylindrical surfaces in the gap, and means for blowing drying gas through one apertured cylindrical surface, through the pulp in the gap, and through apertures in the other cylindrical surface.

4. A method for drying wet fiber-containing pulp, comprising:

mechanically dewatering the wet pulp with a drum or screw press;

passing the pulp through a dryer, in which drying gas is blown through a layer of the pulp in order to evaporate water from the pulp, wherein the pulp is passed through the dryer in a drying space limited by a first and a second cylindrical surface provided with respective apertures, the pulp being pushed forward along the first or the second surface by screw means.

5. A method as claimed in claim 4, further comprising forming the pulp into a gas-permeable pulp layer at an inlet of the dryer, the layer being conveyed forward by the screw means in the drying space formed between the surfaces, from the inlet of the dryer to an outlet of the dryer.

6. A method as claimed in claim 4, further comprising forming the pulp into a gas-permeable pulp layer at an inlet of the dryer, the layer being conveyed forward by the screw means, supported by the first or second surface provided with apertures, from the inlet of the dryer to an outlet of the dryer.

7. A method as claimed in claim 4, further comprising forming the pulp into a pulp layer of substantially uniform thickness at an inlet, the layer being pushed forward along the first or second surface provided with apertures from the first end of the surface towards its other end.

8. A method as claimed in claim 4, wherein the first and second cylindrical surfaces are concentric and fitted inside each other to define the drying space, the method further comprising conveying the pulp layer forward in the drying space, along a spiral path, from an inlet of the cylindrical surfaces to an outlet end of the cylindrical surfaces.

9. A method as claimed in claim 8, wherein the pulp travels between 5–25 times around an inside one of the cylindrical surfaces, as the pulp travels from the inlet end to the outlet end.

10. A method as claimed in claim 4, further comprising blowing drying gas from the apertures of the first or second surface substantially perpendicularly towards the pulp layer travelling between the first and second surfaces.

11. (New) A method as claimed in claim 4, further comprising blowing drying gas in at least one first part of the dryer, from the apertures of the first surface towards the pulp layer travelling in the gap, and in at least one second part of the dryer, from the apertures of the second surface towards the pulp layer travelling in the drying space.

12. A method as claimed in claim 4, further comprising blowing drying gas through the pulp layer alternately in one direction and its opposite direction.

13. A method as claimed in claim 4, wherein a first space is defined within an inside one of the first and second cylindrical surfaces and a second space is defined between an outside one of the first and second cylindrical surfaces and a hood member, and wherein the drying gas is blown through the pulp layer by arranging a pressure difference of about 500–1000 Pa between the first and second spaces.

14. A method as claimed in claim 4, further comprising forming the pulp into a gas-permeable pulp layer having a thickness of approximately 40–120 mm in the drying space between the first and second surfaces provided with apertures.

15. A method as claimed in claim 4, further comprising drying the pulp layer in the dryer with drying gas at a temperature of about 100–300° C. from a dry matter content of about 30–60% to a dry matter content of over 80%.

16. A device for drying fiber-containing pulp comprising:

a mechanical dewaterer comprising a drum or screw press for dewatering the wet pulp; and a dryer in which water is evaporated form the pulp by blowing drying gas through a layer of the pulp, wherein the dryer comprises:

a first and a second cylindrical surface provided with respective apertures, the surfaces being fitted to form a drying space between them, and screw means for conveying the pulp layer forward along the first or second surface in the drying space.

17. A device as claimed in claim 16, wherein the first and second surfaces are cylindrical surfaces which are fitted concentrically inside each other to form the drying space between them.

18. A device as claimed in claim 17, wherein:

a first end of the cylinders is connected to a feed end of the dryer, and a second end is connected to a discharge end of the dryer, and between which is formed the drying space, the dryer further comprising a hood covering the outer cylinder at least partly, the device further comprising a return air system for treating humid gas discharged from the dryer and for returning it to the dryer as drying gas.

19. A device as claimed in claim 18, wherein the dryer is divided into successive segments, and wherein at least two of the segments comprise the return air system that is at least partly separate.

20. A device as claimed in claim 18, wherein the hood is divided by means of intermediate walls fitted mainly in a longitudinal direction of the cylinders into two or more parts, and wherein the device comprises means for blowing drying gas through the pulp layer to be dried, the blowing means effecting in the first part of the dryer, the flow of drying gas from the inner cylinder, through the pulp layer, to the first hood part, and in the second part of the dryer, the flow of drying gas from the second hood part, through the pulp layer, to the inner cylinder.

21. A device as claimed in claim 20, comprising underpressure in the first hood part and overpressure in the second hood part, as compared with pressure prevailing in the inner cylinder.

22. A device as claimed in claim 16, wherein the dryer comprises:

a perforated inner tube which forms the first surface provided with apertures, a perforated outer casing which forms the second surface provided with apertures, the screw means for pushing the pulp layer forward in the drying space between the inner tube and the outer casing, a closed hood covering the perforated outer casing, and means for feeding drying gas from the perforated inner tube through the pulp layer pushing forward in the drying space, and through the perforated outer casing into the closed hood.

23. A device as claimed in claim 19, wherein the dryer further comprises second means for feeding drying gas to a screw conveyor from the closed hood through the perforated outer casing, the pulp layer pushing forward in the drying space and a wall of the perforated inner tube, inside the inner tube.

24. A device as claimed in claim 14, wherein the inner cylinder is a rotating cylinder, and wherein the screw means comprises a wing fitted spirally around the casing of the inner cylinder.

25. A device as claimed in claim 13, wherein a distance between the first and second surfaces forming the drying space is approximately 40–120 mm.

26. A device as claimed in claim 14, wherein a diameter of the inner cylindrical surface is about 2–5 m.

27. A device as claimed in claim 14, wherein an inlet for the pulp to be dried is arranged at a first end of the cylindrical surfaces and an outlet for the dried pulp is arranged at an opposite end of the surfaces.

28. A device as claimed in claim 13, further comprising a mechanical pulp shredder disposed between the mechanical dewaterer and the dryer, the mechanical pulp shredder comprising a fine pulverizer by means of which the fibers are separated from one another before drying.

29. A method as claimed in claim 14, wherein the thickness of the gas-permeable pulp layer is about 80 mm.

30. A method as claimed in claim 15, wherein the pulp layer is dried to a dry matter content of about 85–90%.

31. A device as claimed in claim 25, wherein the distance between the first and second surfaces forming the drying space is about 80 mm.

* * * * *

UNITED STATES PATENT AND TRADEMARK OFFICE

CERTIFICATE OF CORRECTION

PATENT NO. : 6,393,728 B1
DATED : May 28, 2002
INVENTOR(S) : Sairanen et al.

It is certified that error appears in the above-identified patent and that said Letters Patent is hereby corrected as shown below:

Column 3,
Line 59, delete "5%" with -- 50% --.

Signed and Sealed this

Eighteenth Day of February, 2003

JAMES E. ROGAN
*Director of the United States Patent and Trademark Office*